US005284205A

United States Patent [19]

Smith

[11] Patent Number: 5,284,205

[45] Date of Patent: Feb. 8, 1994

[54] METAL TO METAL SEAL FOR WELL SAFETY VALVE

[75] Inventor: Roddie R. Smith, Plano, Tex.

[73] Assignee: Halliburton Company, Duncan, Okla.

[21] Appl. No.: 861,995

[22] Filed: Apr. 1, 1992

[51] Int. Cl.[5] ..... E21B 33/10

[52] U.S. Cl. ..... 166/72; 166/324; 285/917

[58] Field of Search ..... 166/344, 319, 316, 324, 166/332, 72, 917; 285/137.2, 920; 137/515.5

[56] References Cited

U.S. PATENT DOCUMENTS

| | | | |
|---|---|---|---|
| 3,885,627 | 5/1975 | Berry et al. | 166/316 |
| 4,743,033 | 5/1988 | Guess | 166/319 X |
| 4,834,183 | 5/1989 | Vinzant et al. | 166/332 |
| 4,945,993 | 8/1990 | Dickson et al. | 166/321 |
| 4,979,721 | 12/1990 | Gilbert | 137/515.5 |
| 5,183,115 | 2/1993 | Gano | 166/322 X |
| 5,183,268 | 2/1993 | Wong et al. | 166/88 X |

FOREIGN PATENT DOCUMENTS

| | | |
|---|---|---|
| 2148979 | 9/1983 | United Kingdom . |
| 2180571 | 9/1985 | United Kingdom . |

*Primary Examiner*—Ramon S. Britts
*Assistant Examiner*—Roger J. Schoeppel
*Attorney, Agent, or Firm*—Tracy W. Druce; Monty L. Ross

[57] ABSTRACT

A metal to metal seal (10) is provided that comprises an annular seat (66), a seal member (90) having annular metal skirt (91) adapted to engage the annular seat (66), an undercut section behind the skirt (91), and an annular retainer member (78) disposed in the undercut section behind the skirt (91), the skirt (91) being adapted to deflect toward the retainer member (78) when pressured against the annular seat (66), the amount of deflection being limited by the angular distance between the skirt (91) and the retainer member (78). An annular stop member is provided (144) for optionally transferring excess bearing load around the skirt (91) and an adjustment member is provided (176) for selectively controlling the portion of the bearing load carried by the skirt (91) and to limit deflection of the skirt. Use of the subject metal to metal seal is (10) as a piston seal in surface controlled subsurface safety valves (38) employed in the oil and gas industry.

21 Claims, 6 Drawing Sheets

METAL TO METAL SEAL FOR WELL SAFETY VALVE

BACKGROUND OF THE INVENTION

1. Field of the Invention

This invention relates to metal to metal seals, and more particularly, to metal to metal piston seals for surface controlled subsurface safety valves used in the oil and gas industry. One aspect of the invention relates to an improved metal to metal piston seal comprising a seal member adapted to provide sealing engagement with a cooperating annular stop at both low and high pressures.

2. Description of Related Art

Surface controlled subsurface safety valves having pistons with conventional metal to metal piston seals are disclosed, for example, in U.S. Pat. No. 4,945,993, which is incorporated by reference herein. Such valves typically comprise a housing having a longitudinal bore communicating with a well tubing string, a valve closure means biased to seal off the bore, and an operator tube adapted to open the valve closure means in response to control fluid pressure. As shown in U.S. Pat. No. 4,945,993, the control fluid pressure acts on a piston means comprising a seal assembly and a cylindrical rod that are slidably disposed in a small diameter longitudinal bore offset from the main valve bore. The operator tube and piston means are upwardly biased by means such as a coil spring annularly disposed around the operator tube. When control fluid pressure in the small diameter bore is decreased below a preselected value, the biasing means moves the operator tube upward to allow the valve closure means to return to its closed position.

The seal assembly of the piston means comprises seal members adapted to prevent control fluid from leaking past the piston in the small diameter bore and seal members adapted to prevent well fluids from flowing back into the control line. A seal member is desirably provided at the top of the seal assembly to block the leak path from the well bore back into the control line. Because of the high pressures and hostile environments in which the piston seal assemblies must often operate, metal to metal seals are preferred for use as the blocking seals.

Conventional metal to metal seals are generally designed for either low or high pressure applications. In a low pressure environment, less contact stress is provided between the sealing elements, and one must rely on precision machining and fit or else use a material such as an elastomer, a non-elastomer, a softer metal, or the like, that will deform to make the necessary seal. Similarly, in a high pressure environment, precision machining and fit are particularly important with conventional seal designs because softer metals will deform and cannot withstand the contact stresses needed to make the seal.

In the past, piston seal assemblies used in subsurface safety valves such as those disclosed in U.S. Pat. No. 4,945,993 have been provided with upwardly facing seat inserts similar to machined bolts. Such seat inserts have had hemispherical or chamfered sealing surfaces adapted to provide metal to metal sealing engagement with a downwardly facing annular shoulder in the small diameter bore. With the prior art metal to metal seals, however, leakage has sometimes occurred due to surface imperfections, loose tolerances, and the like.

A metal to metal piston seal is therefore needed that can be satisfactorily used at either low or high pressures, and that will accommodate imperfections of fit or finish.

SUMMARY OF THE INVENTION

According to the present invention, a metal to metal seal assembly is provided that is particularly useful, for example, as a piston seal in surface controlled, subsurface safety valves employed in oil and gas wells. The metal to metal seal assembly of the invention is adapted to provide a fluid-tight seal at either low or high pressures.

According to one embodiment of the present invention, a metal to metal seal is provided that comprises a seal member having an annular metal skirt adapted to engage an annular metal seat, an undercut section behind the skirt, and an annular backup member disposed in the undercut section behind the skirt, the skirt being adapted to deflect toward the backup member when pressured against the annular metal seat. According to this embodiment of the invention, the amount of deflection of the annular metal skirt is limited by the angular distance between the skirt and the backup member.

According to another embodiment of the invention, a metal to metal seal assembly is provided that comprises a seal member having a deflectable annular metal skirt adapted to engage an annular metal seat, and means for transferring the bearing load around the annular metal skirt when operating at high pressures. According to one preferred embodiment of the invention, the means for transferring the bearing load is a packing retainer adapted to no-go against an annular shoulder adjacent to the annular metal seat of the seal member.

According to another embodiment of the invention, a metal to metal seal assembly is provided that comprises a seal member having a deflectable annular metal skirt adapted to engage an annular metal seat, and means for supporting the bearing load when operating at high pressures to avoid excessive loading on the seal member. According to one preferred embodiment of the invention, adjustable means are provided for selectively limiting the maximum bearing load that can be exerted on the seal member and for supporting higher loads independently of the seal member.

According to one preferred embodiment of the invention, a surface controlled, subsurface safety valve is provided that comprises a piston seal assembly with at least one metal to metal seal having an annular metal seat member in combination with a seal member further comprising an annular metal skirt, and a backup member disposed in an undercut area behind the skirt. The included angle between the overlying skirt and the support surface of the underlying backup member is preferably reduced as the skirt deflects after contacting the seat member to effect the seal.

According to another preferred embodiment of the invention, a static metal to metal seal is provided that is adapted for use at high or low pressures ranging, for example, from about 200 to about 15,000 psi.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
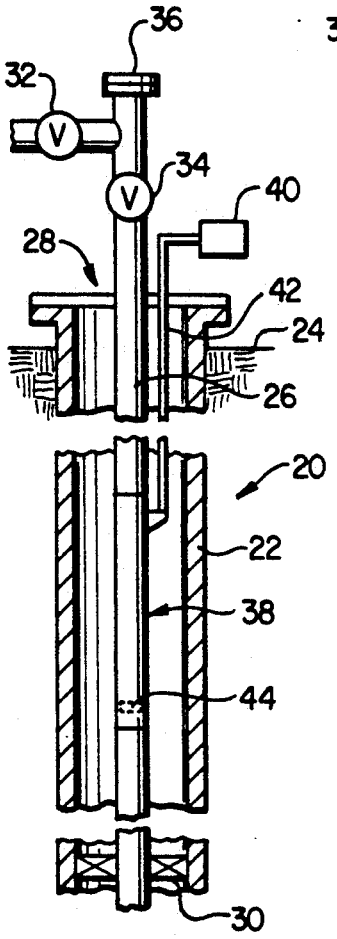
FIG. 1 is a schematic view in section and elevation of a typical well completion including a tubing retrievable subsurface safety valve with a flapper type valve closure means.

Referring to FIG. 1, well completion 20 includes casing string 22 extending from well surface 24 to a hydrocarbon producing formation (not shown). Tubing string 26 is concentrically disposed within casing 22 and extends from wellhead 28 through production packer 30, which seals between tubing string 26 and casing 22. Packer 30 directs formation fluids such as oil, gas, water and the like into tubing string 26 from perforations (not shown) in casing 22 which admit formation or well fluids into the well bore. Well fluids frequently carry sand or other debris which may accumulate at locations in tubing string 26 having low fluid velocity. Flow control valves 32, 34 at well surface 24 control fluid flow from tubing string 26. Wellhead cap 36 is provided on wellhead 28 to permit servicing well 20 via tubing string 26 by wireline techniques which include the installation and removal of various downhole tools (not shown) within tubing string 26. Other well servicing operations which may be carried out through tubing string 26 are bottom hole temperature and pressure surveys.

Surface controlled subsurface safety valve 38 embodying the features of the invention is installed in well completion 20 as a part of tubing string 26 to control fluid flow to the well surface via tubing string 26 from a downhole location. Safety valve 38 is operated by control fluid conducted from hydraulic manifold 40 at the well surface via control line conduit 42 which directs the control fluid signal to safety valve 38. Hydraulic manifold 40 generally includes pumps, a fluid reservoir, accumulators and control valves for the purpose of providing control fluid pressure signals for holding safety valve 38 open or closing the valve when desired. Manifold 40 also includes apparatus which functions in response to temperature, surface line leaks, and other emergency conditions under which well 20 should be shut in.

Figure 2:
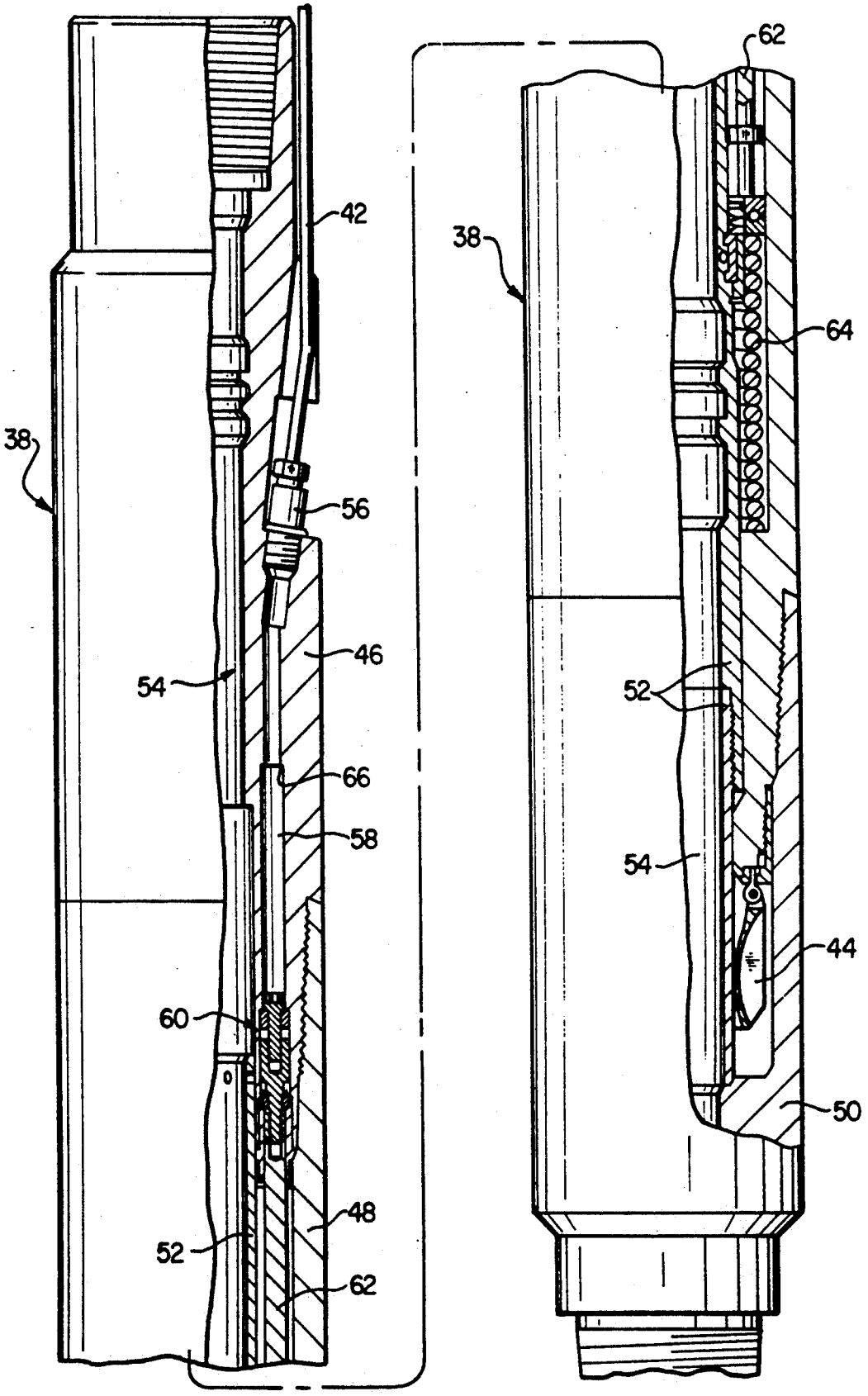
FIGS. 2A and 2B taken together form an elevation view, partially in section and partially broken away, of a subsurface safety valve and operator tube incorporating the present invention and showing the safety valve in its open position.

Safety valve 38 preferably includes flapper type valve closure means 44 adapted to swing between the closed position schematically represented in FIG. 1 and its open position as shown in FIG. 2B. Referring to FIGS. 2A and 2B, safety valve 38 comprises housing subassemblies 46, 48, 50 having operator tube assembly 52 slidably disposed therein around longitudinal bore 54. The lower portion of operator tube assembly 52 is shown holding flapper closure means 44 in the open position. Control fluid pressure is being exerted through control line conduit 42, threaded connection 56 and stepped small diameter bore 58 against piston assembly 60 and rod 62. When rod 62 is held in the downward position shown in FIGS. 2A and 2B, coil spring 64 is compressed and operator tube assembly 52 is maintained in its downward position to hold flapper 44 open.

Figure 3:
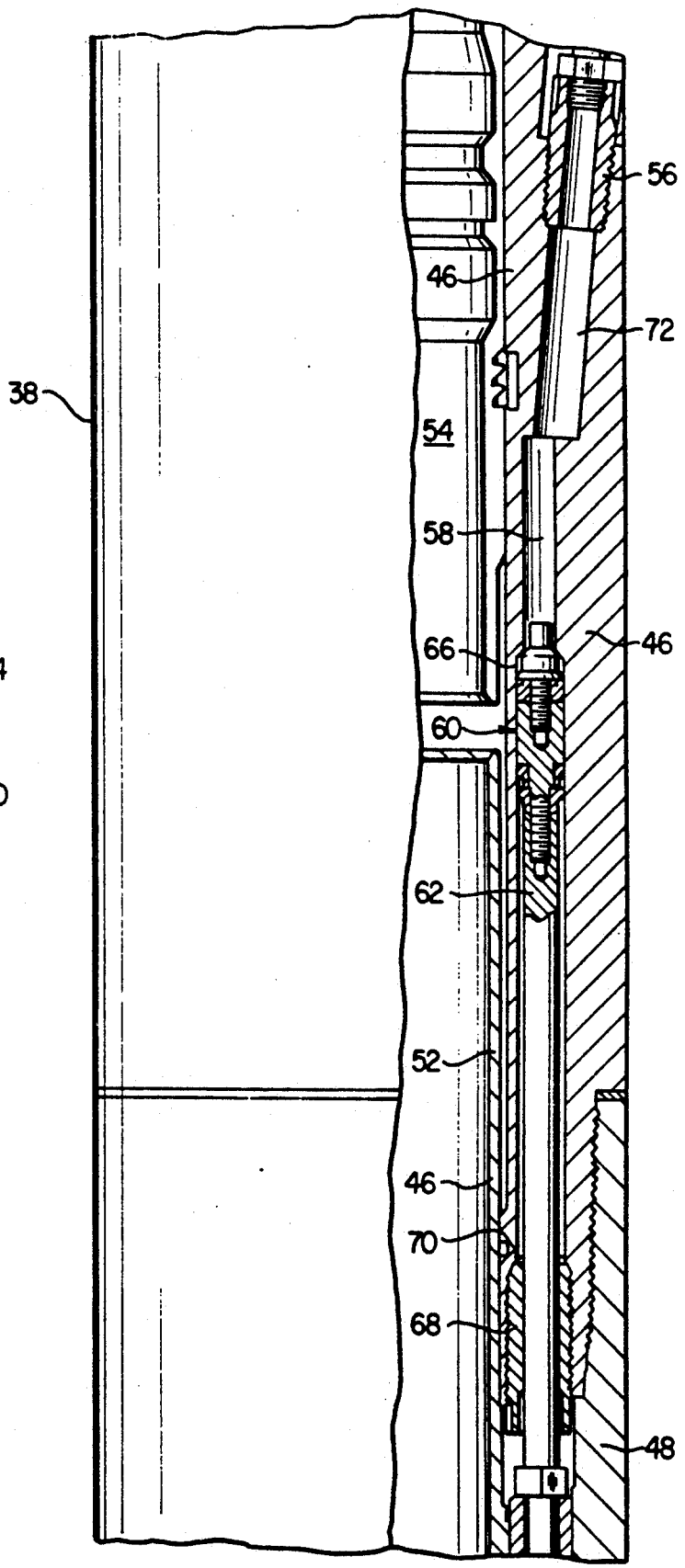
FIG. 3 is an enlarged detail view, partially in section and partially broken away, of the upper portion of the small diameter bore providing control fluid communication to the subsurface safety valve, with the piston shown in the seated upper position corresponding to the closed position of the valve.

If control fluid pressure is released, coil spring 64 forces rod 62 and piston assembly 60 upwardly through stepped small diameter bore 58 until piston assembly 60 reaches upper stop seat 66 as shown in FIG. 3. Referring to FIG. 3, stepped small diameter bore 58 is preferably drilled into top housing subassembly 46 from the lower end during fabrication of safety valve 38. Following insertion of piston assembly 60 and rod 62 into bore 58, end cap 68 is threaded into the lower portion of bore 58. Cap 68 surrounds rod 62, and lower annular seat 70 of cap 68 is adapted to limit the downward range of travel of piston assembly 60 inside bore 58. The uppermost portion of bore 58 communicates with angular passageway 72, which is preferably drilled into top housing subassembly 46 and tapped to receive threaded connection 56.

Figure 4:
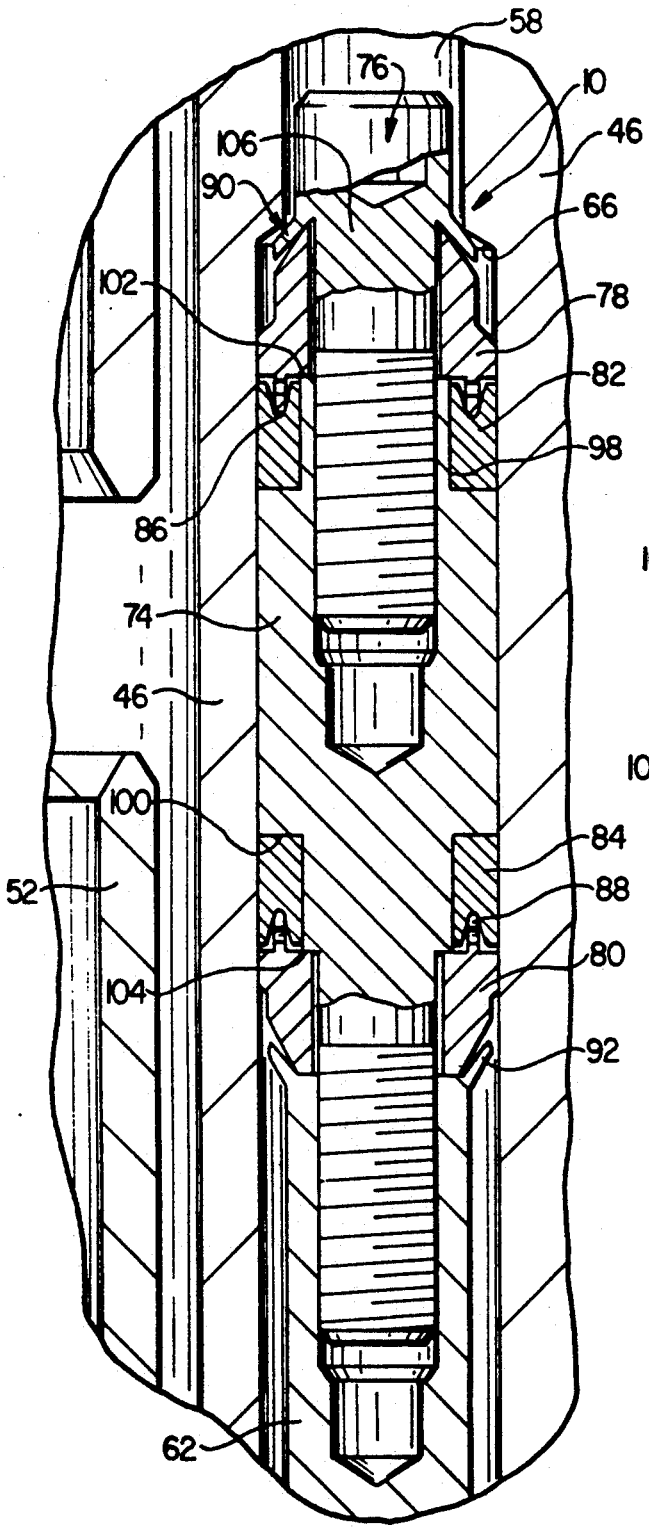
FIG. 4 is a further enlarged detail view in section and elevation of the piston in its upper seated position as shown in FIG. 3.
Figure 5:
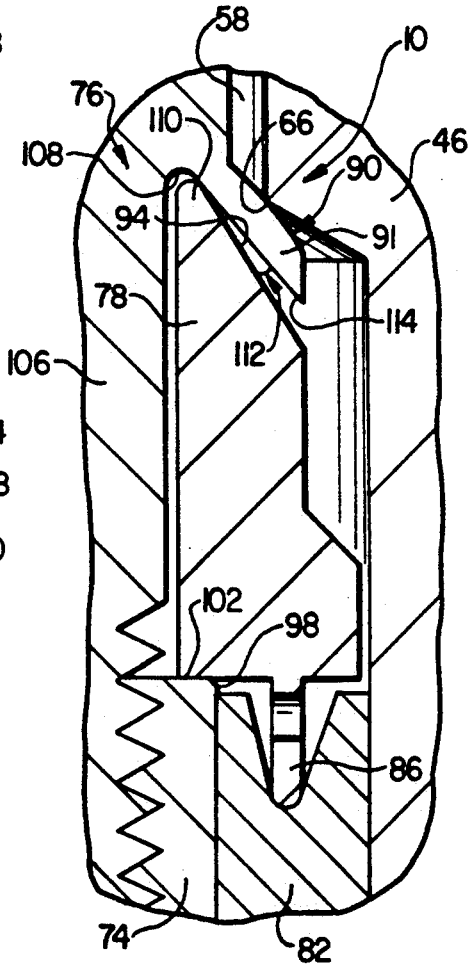
FIG. 5 is a further enlarged detail view in section and elevation of the upper annular seat, upper seal member and upper packing retainer with the piston in its upper seated position as shown in FIGS. 3 and 4.
Figure 6:
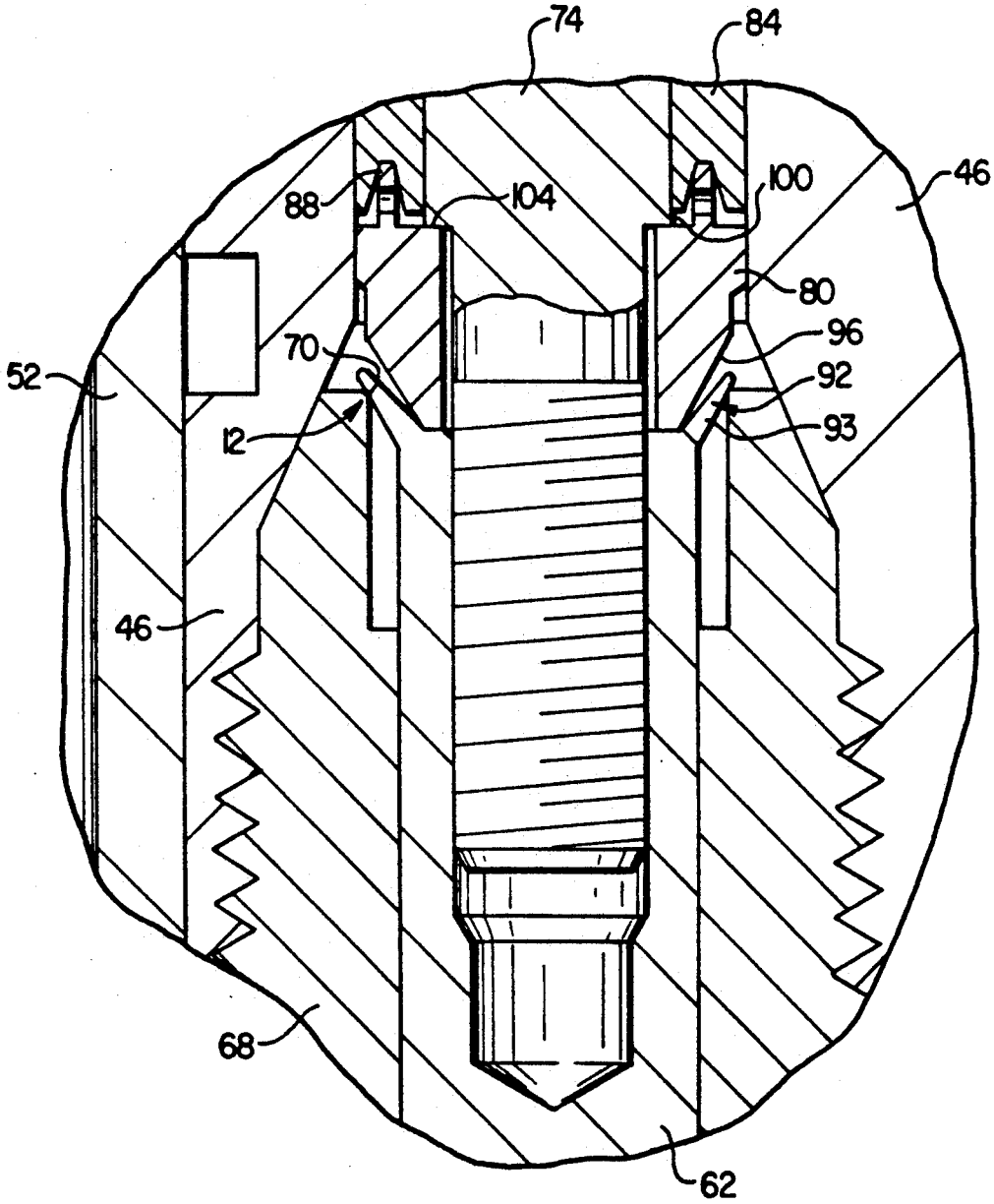
FIG. 6 is a detail view in section and elevation of the lower annular seat, lower seal member and lower packing retainer with the piston in its lower seated position.

The structure and operation of piston assembly 60 and the novel metal to metal seal of one preferred embodiment of the invention are further described and explained in relation to FIGS. 4, 5 and 6. FIGS. 4 and 5 show piston assembly 60 in its upper position within bore 58 in greater detail than is visible in FIG. 3. FIG. 6 shows the lower portion of piston assembly 60 in its lower position within bore 58 in greater detail than is visible in FIG. 2A.

Referring to FIG. 4, piston assembly 60 preferably further comprises piston 74, seal carrier 76, upper packing retainer 78, lower packing retainer 80, and U-cup seals 82, 84. Piston 74 has an upwardly extending box end adapted to threadedly engage seal carrier 76 and a downwardly extending pin end adapted to threadedly engage rod 62. Upper packing retainer 78 surrounds stem 106 of seal carrier 76 and is secured against upwardly facing annular shoulder 102 of piston 74 as stem 106 is threaded into the top of piston 74. Lower packing retainer 80 similarly surrounds the lower pin end of piston 74 and is held against downwardly facing annular shoulder 104 of piston 74 as rod 62 is threaded onto the lower end of piston 74.

Annular U-cup seals 82, 84 (Variseals) are disposed in recesses 98, 100 around the upper and lower ends, respectively, of piston 74, and are held in position by annular tongues 86, 88 of upper and lower packing retainers 78, 80. The U-cup seals may function as a backup for the metal to metal seal at low pressures, are helpful in preventing gas migration into control line conduit 42 (FIG. 2A) during travel of piston assembly 60 between upper annular seat 66 and lower annular seat 70, and in particularly harsh environments, can assist in cleaning the inside wall of bore 58.

The structure and operation of a preferred embodiment of metal to metal seal 10 of the invention is further described and explained in relation to FIG. 5. Referring to FIG. 5, seal carrier 76 preferably comprises upper seal member 90, which further comprises annular metal skirt 91 having a maximum diameter large enough that upper seal member 90 will engage upper annular seat 66 whenever piston 74 is forced upwardly within bore 58. Upper seal member 90 is preferably undercut to a thickness that will permit a slight downward flexure of skirt 91 whenever it contacts upper annular seat 66 at a design pressure differential ranging from about 200 psi up to about 15,000 psi. The undercut beneath upper wedge seal member 90 preferably extends upwardly and radially inward, terminating in radius 108 between upper seal member 90 and stem 106 of seal carrier 76. The thickness of skirt 91 of upper seal member 90 needed to achieve the desired flexure will naturally depend upon the maximum diameter of upper seal member 90 relative to the diameters of bore 58 and stem 106, and upon the type of metal from which seal carrier 76 is made. Whatever metal is used in making upper seal member 90, it should exhibit sufficient resilience to return substantially to its original configuration once control fluid pressure is again increased sufficiently to force piston 74 downwardly inside bore 58.

As shown in FIGS. 4 and 5, seal carrier 76 including upper seal member 90 and stem 106 is made from a single piece of metal. It will be understood and appreciated, however, that seal carrier 76 of piston 74 can also be made in more than one piece if desired, for example, to reduce the amount of machining that might otherwise be required to produce annular skirt 91 as a unitary, integral part of seal carrier 76.

To prevent skirt 91 of upper seal member 90 from flexing so far down that it is crushed against stem 106, thereby permitting seal carrier 76 to be forced too far upward into bore 58 beyond upper annular seat 66, upper packing retainer 78 is preferably provided with upper shoe 94. Upper shoe 94 is an inclined annular surface on upper packing retainer 78 that provides bearing support under upper seal member 90. As seen in FIG. 5, nose 110 of upper packing retainer 78 is adapted to slide upwardly into the undercut area beneath annular skirt 91 and to contact the underside of upper seal member 90 at a point radially inward of upper annular seat 66. Whenever annular skirt 91 contacts upper annular seat 66 and the pressure differential across piston 74 increases to a point where annular skirt 91 begins to flex downward, annular skirt 91 will bend around nose 110 of upper packing retainer 78. The extent of such bending is limited by angle 112 between lower surface 114 of annular skirt 91 and shoe 94 of upper packing retainer 78. As angle 112 is reduced to zero by increasing the pressure exerted on piston 74 from below relative to the pressure being exerted from above through control line conduit 42 (shown in FIG. 2), lower surface 114 of skirt 91 of upper seal member 90 is folded downward against shoe 94.

Annular skirt 91 of the invention is preferably designed to allow it to deflect a minor amount upon contacting annular seat 66 to generate the desired bubble tight seal. At low pressures, the deflection or elastic deformation of annular skirt 91 that occurs due to its relatively thin cross section assists in establishing the desired seal. When the transition from low pressure to high pressure occurs, after annular skirt 91 deflects a predetermined, maximum amount, inclined shoe 94 of upper packing retainer 78 provides a support for the seat. The packing retainer and the seal member thereafter cooperate to support the added bearing load due to the high pressure. Therefore, according to one preferred embodiment of the invention, where the design range for metal to metal seal 10 of the invention covers a broad range of operating pressures (such as for example, from about 200 to about 15,000 psi.), it may be desirable to make annular skirt 91 flexible enough to deflect at the lower end of the pressure range and to rely on shoe 94 to back up annular skirt 91 at the upper end of the pressure range. However, if annular skirt 91 is made too thin for the particular design loads, relative diameters and material of construction, it may be pinched off between nose 110 and upper annular seat 66.

According to another embodiment of the invention, upper seal member 90 is constructed so that angle 112 will not be reduced to zero over the design load of metal to metal seal 10. This will permit the slight deflection that is needed in annular skirt 91 to provide the desired seal between annular skirt 91 and upper annular seat 66. If upper seal member 90 is made so that annular skirt 91 is so thick that it either does not deflect over the designed operating range, or so thin that it is mashed flush against shoe 94 whenever piston 74 is in its uppermost position, metal to metal seal 10 functions much like a conventional metal to metal seal. Other embodiments of the subject invention that are useful in avoiding these difficulties are described and explained later in relation to FIGS. 7 and 8.

Referring again to FIGS. 2A, 3, 4 and 6, the lower end of piston 74 is provided with structure similar to that discussed above in relation to metal to metal seal 10 of the invention. It is understood, however, that it is not required for purposes of the present invention that the metal to metal seal of the invention be used on both ends of piston 74. Because the lower seal on piston 74 operates primarily as a liquid seal, rather than as both a gas and liquid seal in the manner of the upper seal on piston 74, conventional sealing means can be used for providing a seal between piston assembly 60 and lower annular seat 70 of cap 78 whenever piston assembly 60 is in its lowest position as shown in FIG. 2A.

Referring to FIG. 6, where a metal to metal seal of the type disclosed above in relation to FIGS. 4 and 5 is also desired for the lower end of piston 74, annular lower packing retainer 80 is preferably disposed around the pin end of piston 74 between rod 62 and downwardly facing annular shoulder 104. U-cup seal 84 sits in annular recess 100 on piston 74, and is engaged by upwardly extending annular tongue 88 of lower packing retainer 80. The upwardly extending end of rod 62 is preferably machined to create lower seal member 92, which is similar in design, construction and operation to upper seal member 90 discussed above. Lower seal member 92 comprises annular skirt 93, oppositely directed relative to annular skirt 91, adapted to contact and slide against lower annular seat 70 of cap 68, deflecting slightly until it is backed up against shoe 96 of lower packing retainer 80, and thereby creating metal to metal seal 12.

Figure 7:
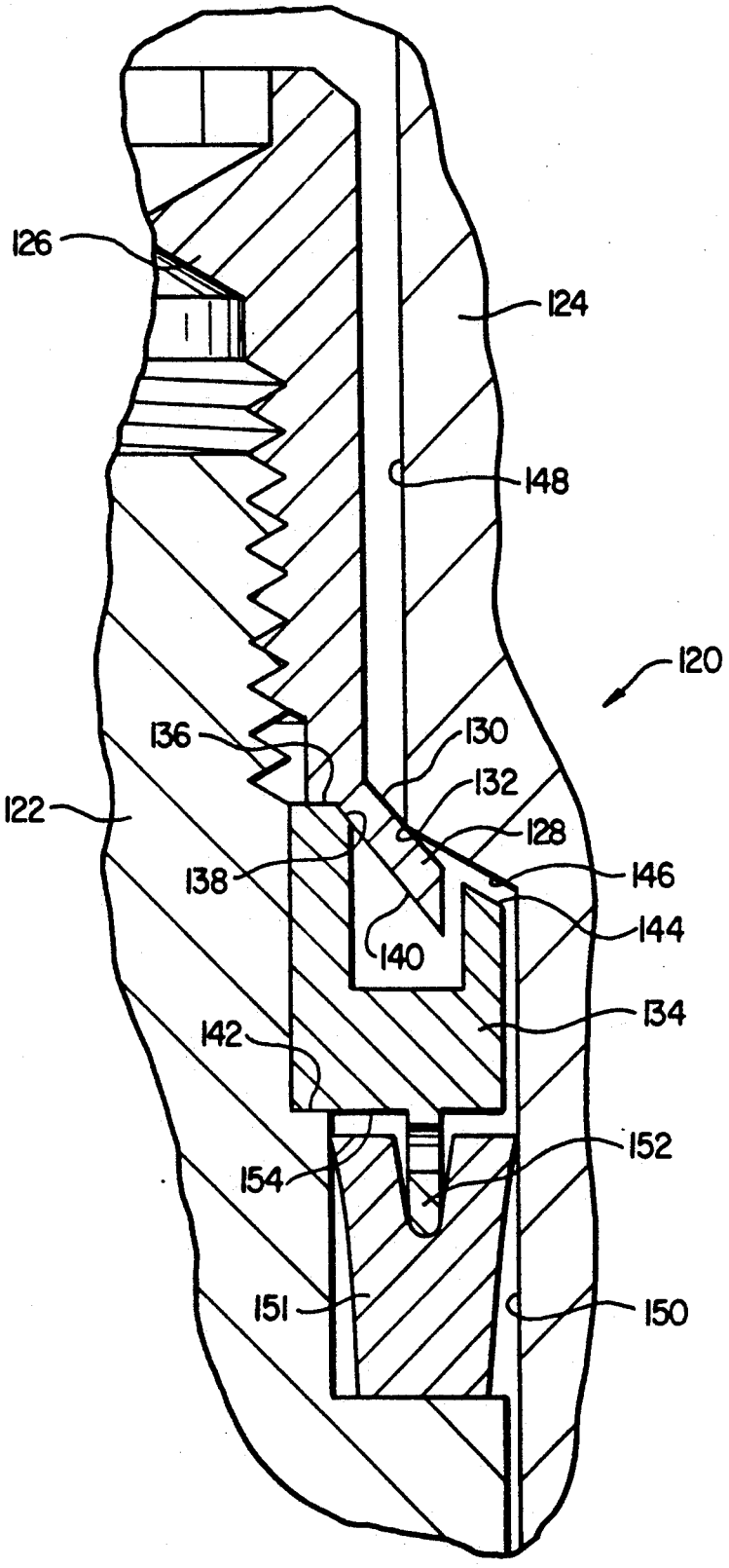
FIG. 7 is a detail view in section and elevation of another seal assembly of the invention showing the upper annular seat, upper seal member, and an upper packing retainer adapted to transfer a high bearing load around the upper seal member from the piston to the housing of the valve.

Referring to FIG. 7, another embodiment of the invention is shown in which seal assembly 120 of a surface controlled, subsurface safety valve is adapted to protect annular skirt 128 from being overpressured when the piston is subjected to high pressures from below. FIG. 7 discloses a portion of the upper part of a piston 122 slidably disposed inside housing 124 of a subsurface safety valve as previously described in relation to FIGS. 1 through 5 above. According to this embodiment, seal carrier 126 is threaded onto the pin end of piston 126, and comprises annular metal skirt 128 having outwardly facing, overlying surface 130, which is shown contacting and sealably engaging annular seat 132 of housing 124. Unlike the embodiment previously described in relation to FIGS. 4 and 5, packing retainer 134 does not have a surface that backs up inwardly facing, underlying surface 140 of annular skirt 128 whenever the upward pressure exerted on piston 122 is sufficient to cause skirt 128 to deflect downward due to contact with annular seat 132 between upper bore section 148 and larger diameter, lower bore section 150 of housing 124. Instead, packing retainer 134 comprises upwardly projecting annular nose 136 and annular stop shoulder 144. Annular nose 136 preferably comprises chamfer 138 that provides a surface around which annular skirt 128 can deflect downwardly as seal carrier 126 and annular skirt 128 are forced upwards relative to annular seat 132. In this embodiment of the invention, the extent to which annular skirt 128 can be deflected downwardly is limited by the distance between the upwardly extending annular stop shoulder 144 of packing retainer 134 and annular shoulder 146 of housing 124.

As piston 122 is forced upwardly relative to housing 124, overlying surface 130 of annular skirt 128 contacts and engages annular seat 132. When the upward pressure is sufficient to cause deflection in annular skirt 128, the skirt will bend downward slightly around chamfer 138 of annular nose 136, and overlying surface will slide slightly upwards relative to annular seat 132. The spacing between annular stop shoulder 144 and annular shoulder 146 is desirably such that a fluid tight seal will be formed between overlying surface 130 of annular skirt 128 and annular seat 132, even at relatively low pressures. When seal assembly 120 is subjected to higher pressures, however, annular stop shoulder 144 contacts annular shoulder 146, preventing further upward motion of piston 122 and seal carrier 126 relative to housing 124. Any additional bearing load is thereafter transferred from piston 122 to housing 124 through annular lip 142 of piston 122, the abutting portion of bottom surface 154 of packing retainer 134, and annular stop shoulder 144. Downwardly extending tongue 152 of packing retainer 134 engages a U-cup seal 151 as previously discussed in relation to the first embodiment.

Figure 8:
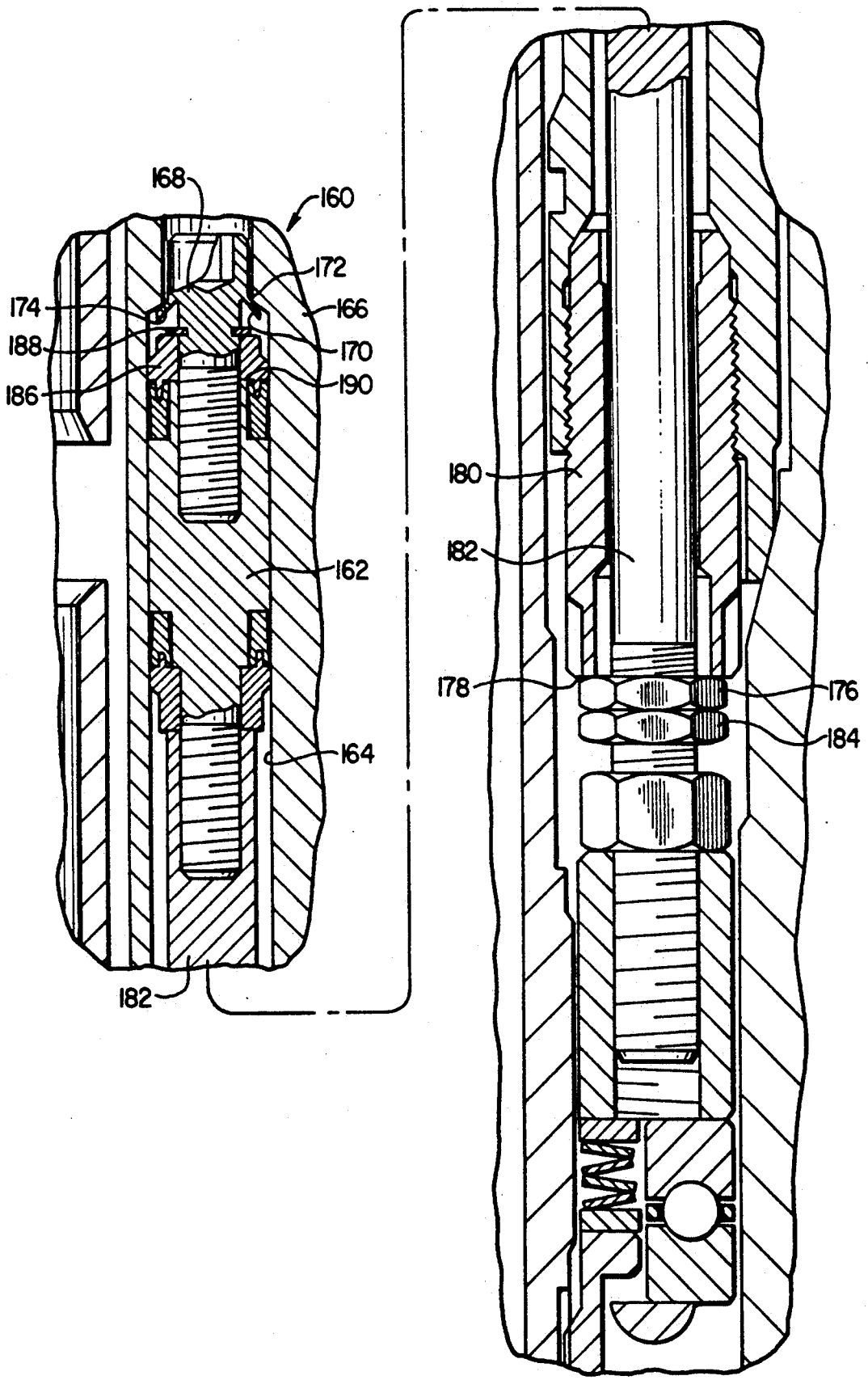
FIG. 8 is a detail view in section and elevation, and partially broken away, of another seal assembly of the invention showing the upper annular seat, upper seal member, and adjustable means on the piston rod for engaging the rod bore end cap to control the maximum bearing load that can be exerted on the seal member and for supporting higher bearing loads independently of the seal member.

According to another embodiment of the invention, as shown in FIG. 8, the excess bearing load is transferred from the piston to the housing of a surface controlled, subsurface safety valve through an adjustment nut located on the piston rod below the end cap. Referring to FIG. 8, another preferred seal assembly 160 is provided that comprises piston 162 slidably disposed inside lower bore section 164 of housing 166, seal carrier 168 having a deflectable annular skirt 170 with an overlying surface sealably engaging annular seat 174 of housing 166, and adjustment nut 176 that abuts against bottom surface 178 of end cap 180, which threadedly engages housing 166. With this embodiment of the invention, the extent to which annular skirt 170 can deflect downwardly after contacting annular seat 174 is controlled by the longitudinal spacing between seal carrier 168 and adjustment nut 176. Adjustment nut 176 is preferably threaded onto piston rod 182 to a position that corresponds to a desired maximum degree of downward deflection of annular skirt 170 during makeup of the safety valve prior to installation in a well bore. Jam nut 184 is provided to maintain adjustment nut 176 in the desired position on piston rod 182. It will be apparent upon reading this disclosure that other similarly effective means for transferring excess bearing load such as a slam close from piston 168 or piston rod 182 to housing 166 can likewise be used within the scope of this invention whenever the metal to metal seal disclosed herein is to be used in a high pressure application. With the embodiment of the invention shown in FIG. 8, packing retainer 186 is maintained in fixed relation to piston 162 by snap ring 188 and lip 190.

Although the annular skirt portion of the seal member of the invention is depicted in the drawings as having substantially parallel overlying and underlying surfaces, it will be appreciated by those of ordinary skill in the art upon reading the disclosure that the surfaces need not be parallel. Thus, for example, the overlying surface might have a convex shape when viewed in cross section rather than the substantially flat shape depicted in FIGS. 4 through 8.

Although the metal to metal seal of the invention is disclosed herein in relation to a preferred application as a piston seal in a surface controlled, subsurface safety valve, it will be understood and appreciated that the same inventive concept is similarly applicable to other devices and systems. Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

We claim:

1. A surface controlled, subsurface safety valve for use in an oil or gas well comprising:

a. a tubular body having a first longitudinally extending bore with a valve closure means disposed therein, and a second longitudinally extending bore radially offset from the first bore with a piston means disposed therein;

b. the second longitudinal bore comprising an upper section having a first diameter, a lower section having a second diameter larger than the first diameter, and an annular shoulder therebetween;

c. means for establishing control fluid communication between the surface and the second longitudinal bore; and d. means for establishing a fluid seal between the piston means and the second longitudinal bore, the seal means further comprising a metal seal member on the piston and a cooperating metal annular seat on the annular shoulder between the upper and lower sections of the second longitudinal bore, the seal member further comprising an inwardly deflectable, annular skirt means for contacting and slidably engaging the annular seat.

2. The safety valve of claim 1 wherein the skirt means has a maximum diameter less than the diameter of the lower section of the second longitudinal bore, but greater than the diameter of the annular seat.

3. The safety valve of claim 1 wherein the seal means further comprises a recess disposed behind the skirt means opposite the annular seat to receive the deflected skirt means.

4. The safety valve of claim 3, further comprising means adjacent to the recess for limiting the deflection of the skirt means into the recess and for limiting the slidable engagement between the skirt means and the annular seat.

5. The safety valve of claim 2 wherein the skirt means comprises a first diameter less than the diameter of the annular seat on the annular shoulder, a second diameter greater than the diameter of the annular seat, and an inclined surface extending therebetween in facing relation to the annular seat.

6. The safety valve of claim 4 wherein the limiting means comprises an annular nose contacting the skirt means and an inclined surface extending radially outward from the nose, the skirt means and the inclined surface of the nose defining an included angle in the recess that decreases with increasing deflection of the skirt means into the recess.

7. The safety valve of claim 1 wherein the seal means will provide a fluid seal between the piston means and the second longitudinal bore at pressures ranging from about 200 psi to about 15,000 psi 8. The safety valve of claim 1 wherein the lower section of the second longitudinal bore further comprises a second annular shoulder with a second annular seat, and wherein the piston means further comprises an oppositely directed seal member having an inwardly deflectable, annular skirt means for contacting and slidably engaging the second annular seat to provide a fluid seal in the opposite direction.

9. A surface controlled, subsurface safety valve comprising a piston seal assembly with at least one metal to metal seal further comprising:

(a) an annular metal seat;

(b) a seal member having an annular metal skirt means comprising a circumferentially extending outer surface of progressively increasing diameter for engaging the annular metal seat along said surface;

(c) a circumferentially extending undercut section behind the skirt means, the skirt means being deflectable into the undercut section upon engagement with the annular metal seat; and (d) an annular backup means disposed in the undercut section behind the skirt to limit the deflection of the skirt into the undercut section.

10. The safety valve of claim 9 wherein the skirt means further comprises an inwardly facing annular surface of progressively increasing diameter, and wherein the annular backup means comprises an annular nose adapted to contact the inwardly facing surface at a point radially inward from the annular metal seat.

11. The safety valve of claim 10 wherein the annular backup means comprises an inclined frustoconical shoe extending radially outward from the annular nose, the shoe and the inwardly facing surface of the skirt defining a circumferentially extending included angle therebetween.

12. The safety valve of claim 11 wherein the skirt means is deflectable toward the backup means when pressured against the annular metal seat, the amount of deflection being limited by the included angle between the shoe and the inwardly facing surface of the skirt.

13. A surface controlled, subsurface safety valve comprising a seal assembly with at least one metal to metal seal for use in preventing fluid bypass between the interior wall of a conduit and a piston having an outside diameter slidably disposed therein, the seal comprising:

a. an annular metal seat disposed on the interior wall of the conduit, the seat having an inside diameter less than the outside diameter of the piston;

b. seal means on the piston comprising an inwardly deflectable, annular metal skirt means for contacting and slidably engaging the annular seat;

c. a recess disposed behind the skirt means opposite the annular seat to receive the deflected skirt means; and d. means adjacent to the recess for limiting the deflection of the skirt means into the recess and the slidable engagement between the skirt means and the annular seat to prevent fluid bypass between the annular seat and the seal means.

14. The metal to metal seal of claim 13 wherein the skirt means comprises a first diameter less than that of the annular seat, a second diameter greater than that of the annular seat, and an inclined surface extending therebetween in facing relation to the annular seat.

15. The metal to metal seal of claim 13 wherein the limiting means comprises an annular nose contacting the skirt means and an inclined surface extending radially outward from the nose, the skirt means and the inclined surface of the nose defining an included angle in the recess that decreases with increasing deflection of the skirt means into the recess.

16. A surface controlled, subsurface safety valve comprising a seal assembly with at least one metal to metal seal comprising:

(a) a stationary annular metal seat;

(b) a movable metal seal member opposite the stationary annular metal seat, the seal member having an annular metal skirt with an overlying, outwardly facing surface angularly disposed relative to the annular metal seat, the overlying surface contacting the annular metal seat as the seal member is moved proximal thereto, and an underlying surface facing away from the annular metal seat;

(c) a circumferentially extending void behind the skirt and adjacent to the underlying surface;

(d) an annular backup means disposed in the void behind the skirt, the annular backup means having an annular nose adapted to contact the underlying surface radially inward of the contact between the underlying surface and the annular metal seat, and an inclined annular shoe extending radially outward from the annular nose, the shoe and the underlying surface of the skirt defining an included angle therebetween;

(e) the skirt being deflectable toward the backup means when pressured against the annular metal seat, the amount of deflection being limited by the included angle between the shoe and the underlying surface of the skirt.

17. A surface controlled, subsurface safety valve comprising a seal assembly with at least one metal to metal seal comprising:

a stationary metal seat;

a metal skirt on a movable seal member;

said metal skirt opposite to, and sealably engageable with said metal seat at a sealing surface;

said metal seat having an inside diameter less than an outside diameter of said metal skirt;

said metal skirt being inwardly deflectable and having an underside opposite said sealing surface; and a bearing support adjacent to, and engageable with, said underside for limiting deflection of said metal skirt.

18. The metal to metal seal as defined in claim 17, further comprising:

a housing in which said movable metal seal member is disposed; and means for transferring a bearing load through said movable metal seal member to said housing.

19. The metal to metal seal as defined in claim 18 wherein said means for transferring a bearing load through said movable metal seal member to said housing further comprises means for isolating the seal means from part of the bearing load.

20. The metal to metal seal as defined in claim 19 wherein said means for isolating the seal means from part of the bearing load comprises a shoulder in said housing and a retainer means connected to said movable metal seal member for abutting said shoulder after the metal skirt has contacted and sealably engaged said metal seat.

21. The metal to metal seal as defined in claim 20 wherein said retainer means comprises adjustable means for selectively controlling the part of the bearing load from which the seal means is not isolated.

* * * * *

UNITED STATES PATENT AND TRADEMARK OFFICE

CERTIFICATE OF CORRECTION

PATENT NO. : 5,284,205

DATED : February 8, 1994

INVENTOR(S) : Roddie R. Smith

It is certified that error appears in the above-indentified patent and that said Letters Patent is hereby corrected as shown below:

On title page, item [54], add --Rennie Dickson, Carrollton, Tex.

Column 10, claim 16, line 50, delete "underlying" and insert --overlying--.

Signed and Sealed this

Twenty-sixth Day of July, 1994

*Attest:*

*Attesting Officer*

BRUCE LEHMAN

*Commissioner of Patents and Trademarks*